US008047040B2

(12) United States Patent
Kanoh et al.

(10) Patent No.: US 8,047,040 B2
(45) Date of Patent: Nov. 1, 2011

(54) WIRE WINDING APPARATUS, METHOD FOR WIRE WINDING AND WIRE WOUND BOBBIN

(75) Inventors: Nobutaka Kanoh, Kariya (JP); Hisashi Kato, Chiryu (JP); Tetsuya Morita, Kariya (JP); Akinori Hoshino, Nisshin (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 437 days.

(21) Appl. No.: 11/882,107

(22) Filed: Jul. 30, 2007

(65) Prior Publication Data

US 2008/0035780 A1 Feb. 14, 2008

(30) Foreign Application Priority Data

Aug. 11, 2006 (JP) ..... 2006-220131

(51) Int. Cl.
*B21B 13/00* (2006.01)

(52) U.S. Cl. ..... 72/224; 72/10.3; 72/12.3; 72/148; 72/205; 72/249

(58) Field of Classification Search ..... 72/8.6, 72/11.4, 12.3, 78, 79, 205, 224, 225, 279, 72/289, 291, 66, 135, 148, 371, 142, 144, 72/249, 10.3; 242/159, 168, 169, 174; 29/605
See application file for complete search history.

(56) References Cited

U.S. PATENT DOCUMENTS

| | | | | | |
|---|---|---|---|---|---|
| 1,732,821 | A | * | 10/1929 | Smith | 470/164 |
| 2,137,611 | A | * | 11/1938 | Hetler | 72/12.1 |
| 2,341,916 | A | * | 2/1944 | Hansen | 72/78 |
| 3,320,788 | A | * | 5/1967 | Meier | 72/224 |
| 3,394,567 | A | * | 7/1968 | Kasecky et al. | 72/9.2 |
| 3,417,593 | A | * | 12/1968 | Lewis | 72/211 |
| 3,570,291 | A | * | 3/1971 | Shiguma | 72/142 |
| 4,028,920 | A | * | 6/1977 | Zander | 72/66 |
| 4,204,417 | A | * | 5/1980 | McVoy, Jr. | 72/206 |

(Continued)

FOREIGN PATENT DOCUMENTS

JP 63-140720 * 6/1988

(Continued)

OTHER PUBLICATIONS

Japanese Office Action issued Jan. 20, 2011 by the Japanese Patent Office in corresponding Japanese Patent Application No. 2006-220131, and English translation of Japanese Official Action.

*Primary Examiner* — Edward Tolan
(74) *Attorney, Agent, or Firm* — Buchanan Ingersoll & Rooney PC

(57) ABSTRACT

A wire winding apparatus for winding a wire on a bobbin includes a forming device forming the wire having a rounded cross section to have a polygonal cross section and a winding device winding the wire formed by the forming device on the bobbin.

13 Claims, 4 Drawing Sheets

U.S. PATENT DOCUMENTS

| | | | | | |
|---|---|---|---|---|---|
| 4,362,038 | A | * | 12/1982 | Katahira et al. | 72/130 |
| 4,375,759 | A | * | 3/1983 | Gentile | 72/131 |
| 4,988,055 | A | * | 1/1991 | Sakai et al. | 242/159 |
| 5,174,013 | A | * | 12/1992 | Hiroshima et al. | 29/605 |
| 5,476,229 | A | * | 12/1995 | Ishikawa | 242/174 |
| 6,049,966 | A | * | 4/2000 | Kawano et al. | 29/596 |
| 6,216,513 | B1 | | 4/2001 | Nakamura et al. | |
| 6,553,650 | B2 | * | 4/2003 | Nakamura et al. | 29/605 |
| 6,748,781 | B2 | * | 6/2004 | Felgen | 72/185 |
| 6,901,782 | B2 | * | 6/2005 | Mikami et al. | 72/225 |

FOREIGN PATENT DOCUMENTS

| | | | | |
|---|---|---|---|---|
| JP | 2-243468 | | * | 9/1990 |
| JP | 7-106178 | A | | 4/1995 |
| JP | 7-183152 | A | | 7/1995 |
| JP | 2000-69721 | A | | 3/2000 |
| JP | 2000-82628 | A | | 3/2000 |
| JP | 2004-343951 | A | | 12/2004 |
| JP | 2005-175180 | A | | 6/2005 |
| JP | 2005-204422 | A | | 7/2005 |
| JP | 2005-235966 | A | | 9/2005 |

* cited by examiner

WIRE WINDING APPARATUS, METHOD FOR WIRE WINDING AND WIRE WOUND BOBBIN

CROSS REFERENCE TO RELATED APPLICATIONS

This application is based on and claims priority under 35 U.S.C. §119 to Japanese Patent Application 2006-220131, filed on Aug. 11, 2006, the entire content of which is incorporated herein by reference.

FIELD OF THE INVENTION

This invention generally relates to a wire winding apparatus, a method for wire winding and a wire wound bobbin.

BACKGROUND

Manufacturing processes for an electric motor include a process of winding wire on a bobbin, where various ingenuities have been implemented. When a wire with a rounded cross section is wound on a cylindrical surface of a round bobbin, for example, the diameter increases as the number of windings progresses, which increases the speed with a constant acceleration. According to JP7-106178A, a wire tension device is provided to respond to the speed change. According to 2005-235966A, when winding a wire having a rounded cross section on a square column surface of a rectangular bobbin, winding of the wire is controlled in response to a rotational position of the rectangular bobbin.

With constructions of known devices and methods where a wire with a rounded cross section is wound on a bobbin, there is a drawback that the wire is not wound with sufficiently high density.

A need thus exists for a wire winding apparatus, a method for winding a wire and a wire wound bobbin, which are not susceptible to the drawback mentioned above.

SUMMARY OF THE INVENTION

According to an aspect of the present invention, a wire winding apparatus for winding a wire on a bobbin includes a forming device forming the wire having a rounded cross section to have a polygonal cross section and a winding device winding the wire formed by the forming device on the bobbin.

According to another aspect of the present invention, a method for winding the wire includes a forming process for forming the wire having a rounded cross section to have a polygonal cross section and a winding process for winding the wire formed in the forming process on a bobbin.

According to still another aspect of the present invention, a wire wound bobbin includes a wire with a polygonal cross section wound on a bobbin.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention will be described below with reference to the attached drawings hereinafter.

Figure 1A:
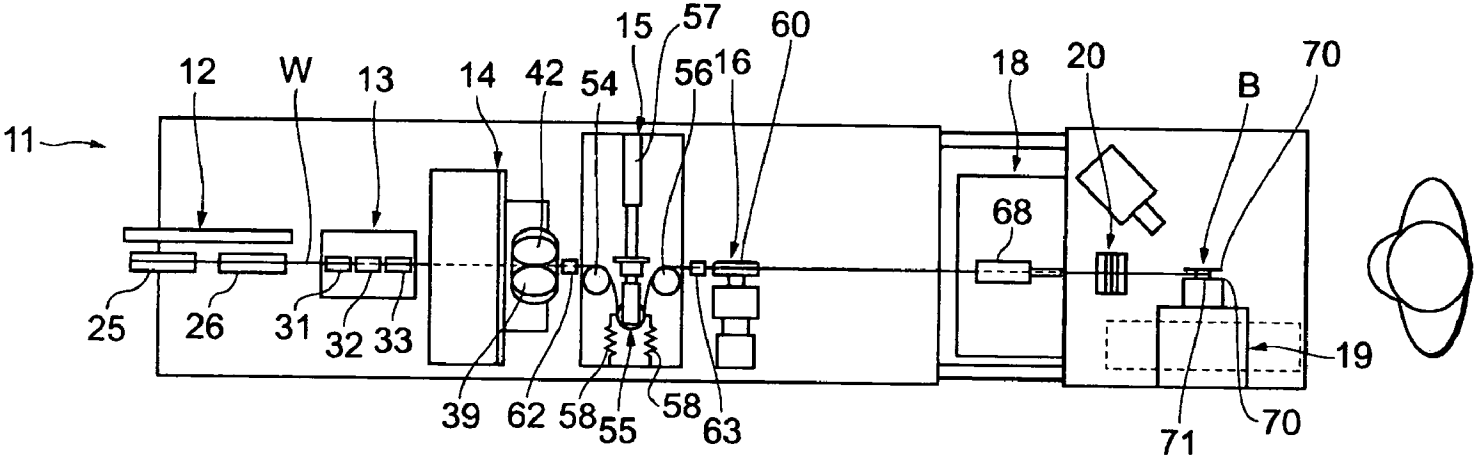
FIG. 1A is a plan view illustrating a wire winding apparatus.
Figure 1B:
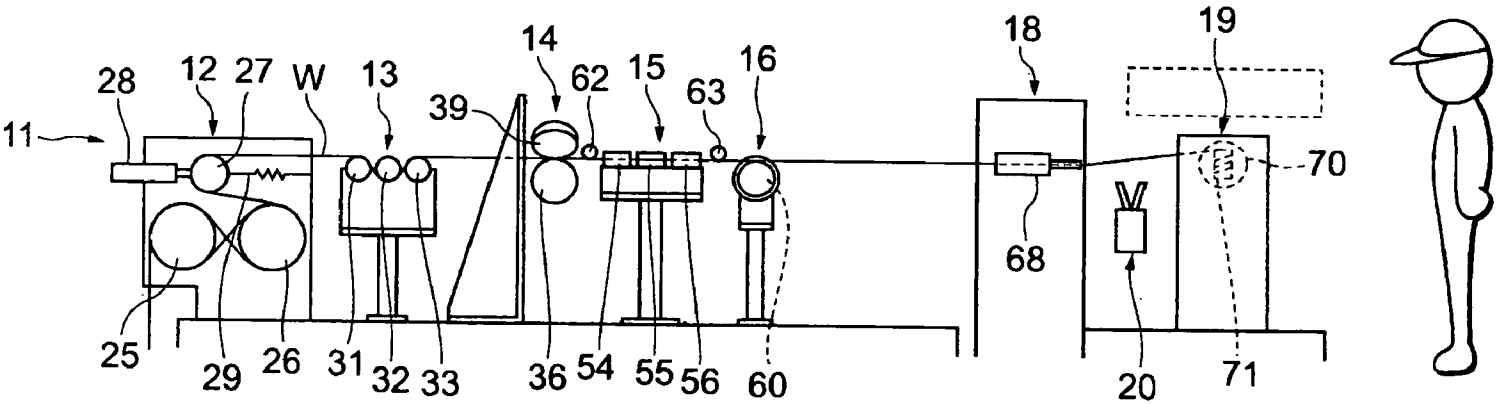
FIG. 1B is a side view illustrating the wire winding apparatus.

As shown in FIG. 1, a wire winding apparatus 11 includes, in order from the upstream for feeding a wire W, a servo tension device 12 serving as a wire feeding device feeding the wire W with a rounded cross section, a tension gauge 13 that detects a tension of the wire W, a rolling and forming device 14 serving as a forming device which forms the wire W having a rounded cross section into the wire W having a substantially polygonal cross section, for example, a substantially equilateral hexagonal cross section by means of a tension force while the wire W is passing therethrough, a simple tension device 15 serving as a tension adjusting device which adjusts the tension of the wire W, a wire speed measurement device 16 that detects a speed of the wire W, a nozzle unit 18 in which the wire W passes through and a spindle unit 19 serving as a winding device which winds the wire W on a bobbin B.

A binding device 20 binding the wire W is provided between the nozzle unit 18 and the spindle unit 19.

A side where the servo tension device 12 is located is referred to as a front side and a side where the spindle unit 19 is located is referred to as a rear side with reference to the entire wire winding apparatus 11, and the front and rear (a longitudinal direction), and left and right (a lateral direction) used hereafter refer to such directions with reference to the entire wire winding apparatus 11.

Referring to FIG. 1, the above described wire winding apparatus 11 provides a series of processes where the wire W does not need to be uninstalled or re-installed from a feeding process where the wire W with a rounded cross section is fed out of the servo tension device 12 through a forming process where the wire W with a rounded cross section is formed into the wire W with a substantially equilateral hexagonal cross section on the rolling and forming device 14, and further to a winding process where the wire W is wound on the bobbin B by the spindle unit 19.

The servo tension device 12 includes rollers 25 and 26 each having a laterally arranged rotation axis and a tension roller 27 having a laterally arranged rotation axis. The wire W with a rounded cross section supplied from a wire supply reel is wound on the rollers 25, 26, and the rollers 25, 26 feed the wire W when either of them is driven by a servomotor. The tension roller 27 is positioned above the rollers 25, 26, and the wire W fed from the rollers 25, 26 is wound thereon.

The tension roller 27 is supported by a low friction cylinder 28 so as to reciprocate in a longitudinal direction of the winding device 11 and is biased forward by a spring 29 to apply tension by means of the biasing force to the wire W that is set on the front side of the tension roller 27. The tension roller 27 feeds the wire W rearward from the upper portion thereof. The servo tension device 12 aims for tension stabilization particularly during winding at a high speed.

The tension gauge 13 includes, for example, three rollers 31, 32 and 33 each having a laterally arranged rotation axis and on which the wire W, fed from the tension roller 27 of the servo tension device 12, is set. The wire W is placed on the upper portion of the roller 31 that is arranged in the front of the tension gauge 13, then is placed on the lower portion of the roller 32 that is arranged in the middle of the tension gauge 13, and then is placed on the upper portion of the roller 33 that is arranged in the rear of the tension gauge 13. Since the tension gauge 13 is for grasping actual values of winding conditions, the tension gauge 13 does not have to be provided if it is not necessary to measure the actual values.

The rollers 25 and 26, and the tension roller 27 of the servo tension device 12, and all the rollers 31, 32 and 33 of the tension gauge 13 are each provided with a groove with semicircular cross section formed on the outer periphery portions thereof respectively so as not to damage the wire W having a rounded cross section.

Figure 2:
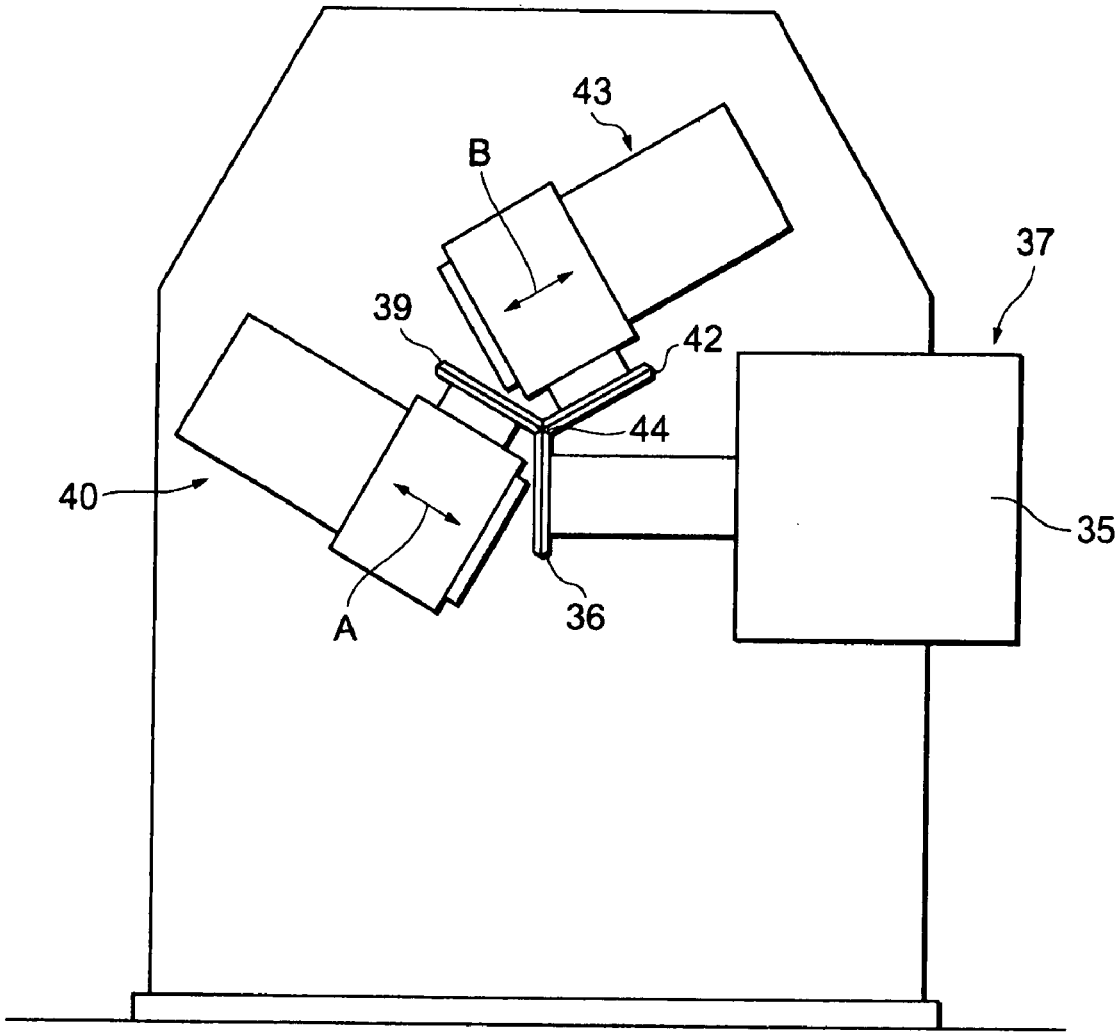
FIG. 2 is a front view illustrating the rolling and forming device.

As shown in FIG. 2, the rolling and forming device 14 includes a servomotor 35, a drive unit 37, a driven unit 40 and a driven unit 43. The drive unit 37 drives a forming roller 36 by means of the servomotor 35 having a laterally arranged rotation axis so that the forming roller 36 rotates in a fixed position about the rotation axis of the servomotor 35. The driven unit 40 having no drive source adjusts the position of a forming roller 39 in a longitudinal direction relative to the forming roller 36 of the drive unit 37 so that the forming roller 39 is arranged in a direction having an angle of one hundred and twenty degrees from the forming roller 36, and the driven unit 40 supports the forming roller 39 position-adjustably in the radial direction (the direction of the arrow A in FIG. 2) while keeping a longitudinal position of the forming roller 39 unchanged. The driven unit 43 having no drive source adjusts the position of a forming roller 42 in a longitudinal direction relative to the forming roller 36 of the drive unit 37 so that the forming roller 42 is arranged in a direction having the angle of one hundred and twenty degrees from the forming roller 36 of the drive unit 37 and from the forming dine 39 of the driven unit 40 in a reverse direction, and the driven unit 43 supports the forming roller 42 position-adjustably in the radial direction (the direction of the arrow B in FIG. 2) while keeping a longitudinal position of the forming roller 42 unchanged.

In a state where the forming rollers 36, 39 and 42 are close to one another, the forming roller 39 is arranged at an upper end of the forming roller 36 which is vertically arranged when seen from the longitudinal direction so that the forming roller 39 and the forming roller 36 make the angle of one hundred and twenty degrees on one side, and the forming roller 42 is arranged at an upper end of the forming roller 36 so that the forming roller 42 and the forming roller 36 make the angle of one hundred and twenty degrees on the opposite side from the above mentioned side.

Figure 3:
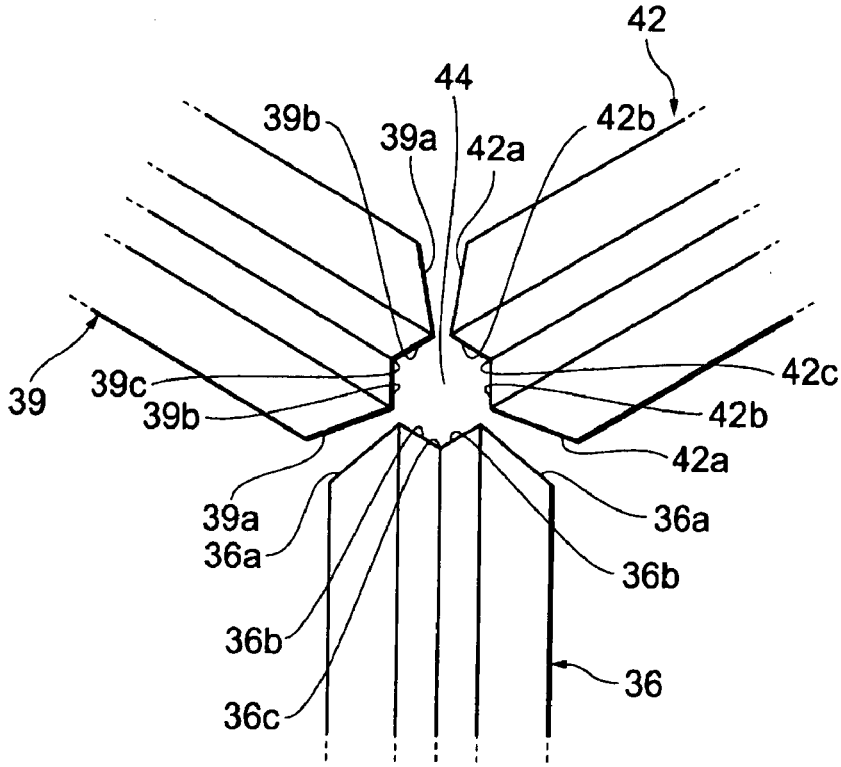
FIG. 3 is an enlarged partial front view illustrating a forming roller of the rolling and forming device.

As shown in FIG. 3, the forming roller 36 is provided with a pair of conic surfaces 36*a*, 36*a* formed on the outer periphery portion thereof and inclined at equivalent angles relative to surfaces perpendicular to the axis, and thus the forming roller 36 is progressively thinner toward the outer periphery side. The forming roller 36 also includes a pair of conic surfaces 36*b*, 36*b* that is formed between the pair of conic surfaces 36*a*, 36*a* and is inclined at equivalent angles relative to the surfaces perpendicular to the axis, and the pair of conic surfaces 36*b*, 36*b* forms a forming recess 36*c* which is recessed in the radial direction.

Similarly, a forming roller 39 is provided with a pair of conic surfaces 39*a*, 39*a* formed on the outer periphery portion thereof and inclined at equivalent angles relative to surfaces perpendicular to the axis. Between the pair of 39*a*, 39*a*, a pair of conic surfaces 39*b*, 39*b* is formed and are inclined at equivalent angles relative to the surfaces perpendicular to the axis. The pair of conic surfaces 39*b*, 39*b* forms a forming recess 39*c* which is recessed in the radial direction.

Similarly, a forming roller 42 is provided with a pair of conic surfaces 42*a*, 42*a* formed on the outer periphery portion thereof and inclined at equivalent angles relative to surfaces perpendicular to the axis. Between the pair of 42*a*, 42*a*, a pair of conic surfaces 42*b*, 42*b* is formed and is inclined at equivalent angles relative to the surfaces perpendicular to the axis. The pair of conic surfaces 42*b*, 42*b* forms a forming recess 42*c* which is recessed in the radial direction.

Figure 4:
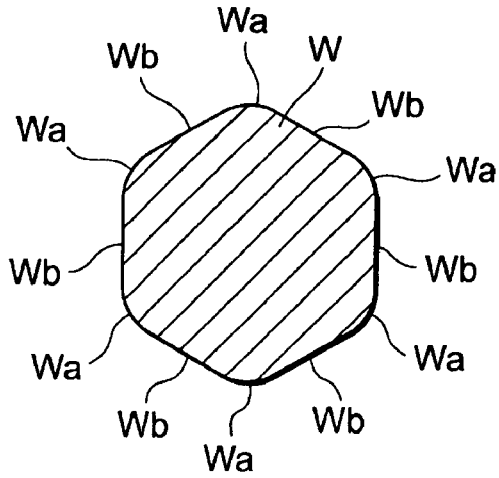
FIG. 4 is a cross section view illustrating the wire after rolled and formed.
Figure 5:
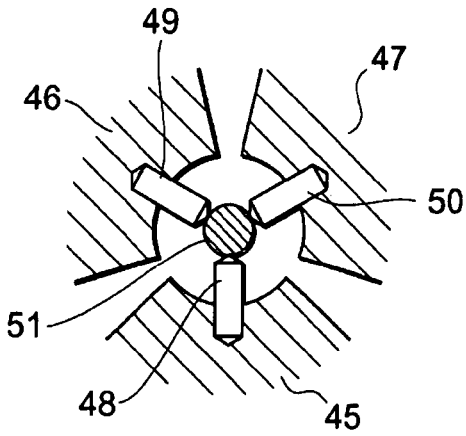
FIG. 5 is an enlarged partial front view illustrating a centering jig or the rolling and forming device.

A forming space 44 having a substantially equilateral hexagonal shape is formed by the forming recesses 36*c*, 39*c* and 42*c* of the three forming rollers 36, 39 and 42 respectively, into which the wire W with a rounded cross section, having a larger area than that of the forming space 44, is passed through so that the wire W is rolled and formed by a tension force of the forming rollers 36, 39 and 42 each rotating in a fixed position respectively. As shown in FIG. 4, the rolled and formed wire W has a substantially equilateral hexagonal cross section having six arcuate corners Wa and flat surfaces Wb arranged between the adjacent corners Wa, Wa, and a diagonal pair of corners Wa, Wa is vertically arranged.

The wire W with a rounded cross section is advanced by the forming roller 36 driven by the servomotor 35 of the drive unit 37 shown in FIG. 2 and, at the same time, the forming rollers 39 and 42 of the driven units 40 and 43 each having no drive source are rotated by the advancement of the wire W.

Since the positions of the driven units 40 and 43 are individually adjustable, sizes of the forming recesses 36*c*, 39*c* and 42*c*, i.e. a size of the hexagon after the wire W is rolled and formed, are determined by the positioning of the driven units 40 and 43 relative to the driven unit 37.

Rollers 45, 46 and 47 for centering are used in order for centering the forming rollers 36, 39 and 42. To perform the centering operation, the rollers 45, 46 and 47 for centering are used instead of the forming rollers 36, 39 and 42 of the drive unit 37 and the driven units 40 and 43. Then a precision shaft 51 is inserted among pins 48, 49 and 50 inserted on the outer periphery portions of the rollers 45, 46 and 47 respectively. The centering operation is completed by adjusting and fixing the positions of the driven units 40 and 43 so that all the pins 48, 49 and 50 come to contact with the precision shaft 51, and then replacing the rollers 45, 46 and 47 for centering with the forming rollers 36, 39 and 42.

The wire W which stably has a substantially equilateral hexagonal cross section is obtained by conducting the above described centering operation by using the rolling and forming device 14, which is a three-way rolling type having one drive unit and two driven units.

The simple tension device 15 shown in FIG. 1 adjusts the tension of the wire W between the rolling and forming device 14 and the spindle unit 19, and includes three rollers 54, 55 and 56 each having a vertically arranged rotation axis, where the roller 55 which is in the middle is laterally offset relative to the rollers 54 and 56 in the front and rear while the rollers 54 and 56 are laterally aligned.

The rollers 54 and 56 in the front and rear are arranged in fixed positions, while the roller 55 in the middle is supported by a low friction cylinder 57 so that the roller 55 laterally reciprocates, and are biased by a spring 58 away from the rollers 54 and 56 in the front and rear.

The roller 55 in the middle applies tension by means of the biasing force of the spring 58 to the wire W, which is set on the opposite side of the roller 55 from the rollers 54 and 56 in the front and rear. The rollers 54, 55 and 56 of the simple tension device 15 are provided with cylindrical surfaces on the outer periphery portions thereof so as to support the wire W with a substantially equilateral hexagonal cross section without damaging the flat surfaces Wb on the left and right thereof.

The wire speed measurement device 16 includes a measurement roller 60 having a laterally arranged rotation axis and contacting with the moving wire W from the downward direction, and detects a movement speed of the wire W on the basis of a rotation speed of the measurement roller 60. The measurement roller 60 is provided with a groove with a V-shaped cross section formed on the outer periphery portion thereof so as to guide the wire W with a substantially equilateral hexagonal cross section without damaging the corner Wa on the bottom thereof. Since the wire speed measurement device 16 is for grasping actual values of winding conditions, the wire speed measurement device 16 does not have to be provided if it is not necessary to measure the actual values.

A guide roller 62 serving as a twist prevention device is provided between the rolling and forming device 14 and the simple tension device 15 to prevent the wire W from twisting (rotation of the wire seen from a direction of advancing the wire), and a guide roller 63 is provided between the simple tension device 15 and the wire speed measurement device 16 to prevent the wire W from twisting.

The guide rollers 62 and 63 each having a laterally arranged rotation axis are provided with grooves with V-shaped cross sections formed on the outer periphery portions thereof so as to guide the wire W with a substantially equilateral hexagonal cross section without damaging the corner Wa on the top or bottom thereof. In this manner, the guide rollers 62 and 63 that prevent the wire W from twisting are arranged between neighboring devices that contact the wire W, where twisting is likely to occur.

The nozzle unit 18 shown in FIG. 1 includes a nozzle 68 that determines a position of the wire W by allowing the wire W to pass therethrough, and that makes the wire W to be wound on the bobbin B in an aligned state with reference to the bobbin B and controls an entwining operation by regulating the nozzle in X, Y and Z directions in response to the wire W changing its position as being wound on the bobbin B by the spindle 19 in the rear.

The above described rollers 25 and 26, and the tension roller 27 of the servo tension device 12, all the rollers 31, 32 and 33 of the tension gauge 13, the forming roller 36 of the rolling and forming device 14, the subsequent guide roller 62, the rollers 54 and 56 in the front and rear of the simple tension device 15 respectively, the subsequent guide roller 63 and the measurement roller 60 of the wire speed measurement device 16 are positioned so that the center of the wire W supported by the above mentioned rollers is laterally in the same position in terms of the wire winding apparatus 11.

The tension roller 27 of the servo tension device 12, the rollers 31 and 33 in the front and rear of the tension gauge 13, the forming roller 36 of the rolling and forming device 14, the subsequent guide roller 62, all the rollers 54, 55 and 56 of the simple tension device 15, the subsequent guide roller 63 and the measurement roller 60 of the wire speed measurement device 16 are positioned so that the center of the wire W supported by the above mentioned rollers is consistent in its height.

The spindle unit 19 supports the bobbin B that is formed with a winding portion 71 between disc-shaped flange portions 70 on both sides of the bobbin B in a state where the flange portions 70 are laterally arranged and the spindle 19 rotates the bobbin B about the lateral axis, where a servomotor controls the number of rotations of the bobbin B. The binding device 20 performs the entwining operation of the wire W.

The above mentioned wire winding apparatus 11 feeds the wire W out of the rolling and forming device 14 synchronously with the spindle unit 19 under servo control of the spindle unit 19 and the rolling and forming device 14. In doing so, the spindle unit 19 rotates at a constant speed (for example at 1000 rpm) while the rolling and forming device 14 drives, without setting torque limit, to give as low a tension as possible to the wire W between the rolling and forming device 14 and the spindle unit 19 on the basis of pulses of an encoder of the spindle unit 19, and so forth (i.e. a read ahead control is performed). Also, the servo tension device 12 drives synchronously with feeding of the wire by rolling and forming device 14.

Further, in performing the above, the simple tension device 15 absorbs synchronization error between the rolling and forming device 14 and the spindle unit 19. Particularly when the number of rotations of the spindle unit 19 is increased to improve production efficiency, the tension applied to the wire W also increases, which is controlled by providing the simple tension device 15 between the rolling and forming device 14 and the spindle unit 19. Since the tension of the wire W is controllable under the predetermined value if the number of rotations of the spindle unit 19 is not increased, the simple tension device 15 is not required.

As described above, when the spindle unit 19 and the rolling and forming device 14 are driven, and the servo tension device 12 is also driven synchronously with the spindle unit 19 and the rolling and forming device 14, the wire W having a rounded cross section fed out of the servo tension device 12 passes through the tension gauge 13, and then undergoes plastic deformation by the three forming rollers 36, 39 and 42 of the rolling and forming device 14 to have a substantially equilateral hexagonal cross section (a forming process). The wire W is then moved by a driving force of the forming roller 36 while being plastically-deformed, passes through the simple tension device 15 and the wire speed measurement device 16, passes through the nozzle 68 of the nozzle unit 18, comes to be wound on the rotating bobbin B on the spindle unit 19, and is then wound on the winding portion 71 of the bobbin B (a winding process).

During this, the simple tension device 15 adjusts the tension of the wire W between the forming process and the winding process (a tension adjusting process). Also, the guide roller 62 between the rolling and forming device 14 and the simple tension device 15 prevents the wire W therebetween from twisting (a twist preventing process), and the guide roller 63 between the simple tension device 15 and the wire speed measurement device 16 prevents the wire W therebetween from twisting (a twist preventing process).

Figure 6:
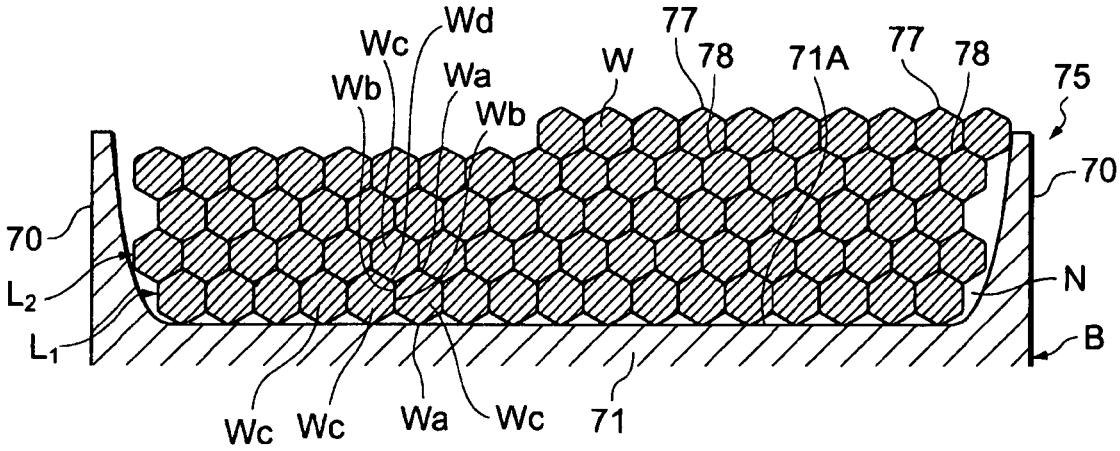
FIG. 6 is an enlarged partial cross section view illustrating a wire wound bobbin.

Under the control of the above mentioned nozzle unit 18, the single wire W with a substantially equilateral hexagonal cross section forms a first layer L1 by being wound on the winding portion 71 of the bobbin B for one layer in such a way that the same corner Wa always contacts with the winding portion 71 and the corner Wa on the opposite side from the corner Wa is always away from the rotational axis of the bobbin B as shown in FIG. 6. That is, the diagonal pair of corners Wa, Wa is arranged perpendicularly to an outer surface (a winding surface) 71A of the winding portion 71 of the bobbin B in such a way that the wound portions Wc, Wc for one winding turn that are adjacent to each other remain in the same positions with reference to an axial direction of the bobbin B so that the flat surfaces Wb, Wb of the wound positions Wc, Wc contact or oppose each other. The wire W then forms a second layer L2 on the bobbin B, on the outer diameter side, by being wound for one layer in such a way that the same corner Wa always fits into a concave portion Wd formed by the adjacent wound portions Wc, Wc that are located in the first layer L1, in the same position as the corner Wa, and in the radial direction of the Bobbin B. The above mentioned winding sequence is repeated for appropriate multiple layers to form a wire wound bobbin 75.

According to the above mentioned embodiment of the present invention, after the wire W with a rounded cross section is formed into the wire W with a substantially equilateral hexagonal cross section on the rolling and forming device 14, the spindle unit 19 winds the wire W with a substantially equilateral hexagonal cross section on the bobbin B in the series of processes, and thus the wire wound bobbin 75 where the wire W is wound with sufficiently high density is obtained.

In addition, since the simple tension device 15 adjusts the tension of the wire W between the rolling and forming device 14 and the spindle unit 19, the wire W incurs neither excess tension nor slack due to lack of tension, and as a result, the roller unit 14 forms the wire W favorably so that the wire W has a substantially equilateral hexagonal cross section and the spindle unit 19 winds the wire W favorably on the bobbin B.

As the wire W is formed to have a substantially equilateral hexagonal cross section, any twisting in the wire W causes defective winding on the bobbin B and such twisting is efficiently prevented by the guide roller 62 between the neighboring devices that contact the wire W, namely the rolling and forming device 14 and the simple tension device 15, where twisting is likely to occur, and similarly by the guide roller 63 between the simple tension device 15 and the wire speed measurement device 16, where twisting is likely to occur.

Further, in the wire wound bobbin 75, the wire W having a substantially equilateral hexagonal cross section is wound on the bobbin B in such a way that the diagonal pair of corners Wa, Wa out of six corners Wa thereof is arranged substantially perpendicular to the outer surface 71A of the winding portion 71 of the bobbin B. Consequently, an outer portion of the wire W wound on the bobbin B has a concave surface having top portions 77 and bottom portions 78 each having an obtuse angle, which increases a surface area exposed to the air, resulting in an improved cooling effect.

The wire W is wound in such a way that the corner Wa of each winding turn of the wound portion Wc fits into the concave portion Wd, of the inner layer, formed by the corners Wa, Wa of the wound portions Wc, Wc that are adjacently wound along the rotation axis of the bobbin B, consequently the wound portions Wc, Wc built up in laminated layers contact with one another in a favorable condition, allowing the wire W to be wound more reliably with higher density.

The wire W may be formed so as to have a cross section of other various substantial polygonal shapes including a substantially square cross section, instead of a substantially equilateral hexagonal cross section.

The bobbin B may be a round bobbin whose outer surface (the winding surface) 71A is in a cylindrical shape or may be a rectangular bobbin whose outer surface (the winding surface) 71A is in a polygonal column shape, for example a square column shape. In cases where the bobbin B is a round bobbin, "Being wound in such a way that the diagonal pair of corners Wa, Wa is substantially perpendicular to the outer surface 71A of the bobbin B" means that the wire W is wound in such a way that the pair of corners Wa, Wa is arranged along a substantial radial direction of the outer surface 71A of the cylinder.

In cases where the bobbin B is a rectangular bobbin, "Being wound in such a way that the diagonal pair of corners Wa, Wa is substantially perpendicular to the outer surface 71A of the bobbin B" means that the wire W is wound in such a way that the pair of corners Wa, Wa is arranged substantially perpendicularly to a flat portion of the outer surface 71A of the polygonal column.

Since a wire speed at the spindle unit 19 represents a kind of sine curve in cases where the bobbin B is a rectangular bobbin, the servomotor 35 of the rolling and forming device 14 and the servomotor of the servo tension device 12 should be controlled to follow the sine curve.

According to the embodiment, the wire W is wound with sufficiently high density.

Due to such a construction, the wire W having a rounded cross section is formed to have a substantially polygonal cross section and then the wire W is wound on the bobbin B by the spindle unit 19 in the series of processes. By winding the wire W with a substantially polygonal cross section on the bobbin B in this manner, the wire W is wound with sufficiently high density.

Due to such a construction, the wire W is wound with sufficiently high density compared to cases where the wire W has a rounded cross section.

The simple tension device 15 adjusting the tension of the wire W may be provided between the rolling and forming device 14 and the spindle unit 19.

Due to such a construction, the simple tension device 15 adjusts the tension of the wire W between the rolling and forming device 14 and the spindle unit 19, consequently the wire W incurs neither excess tension nor slack due to lack of tension. As a result, the rolling and forming device 14 favorably forms the wire W so that the wire W has a substantially polygonal cross section and the spindle unit 19 favorably winds the wire W on the bobbin B.

The guide roller 62, 63 preventing the wire from twisting may be provided between neighboring devices contacting the wire W.

Since the wire W is formed to have a substantially polygonal cross section, any twisting in the wire W causes defective winding on the bobbin B and such twisting is efficiently prevented by the guide roller 62, 63 provided between neighboring devices contacting the wire W, where twisting is likely to occur.

A tension adjusting process adjusting a tension of the wire W may be provided between the forming process and the winding process.

Further, a twist preventing process preventing twist of the wire that occurs between neighboring devices contacting the wire may be provided.

In cases where the wire W has a substantially equilateral hexagonal cross section, the wire W is wound so that the diagonal pair of corners Wa, Wa of the hexagonal cross section is arranged perpendicularly to the winding surface 71A of the bobbin B.

The bobbin B may be a round bobbin whose winding surface 71A is in a cylindrical shape or may be a rectangular bobbin whose winding surface 71A is in a polygonal column shape, for example a square column shape, and "Being wound in such a way that the diagonal pair of corners Wa, Wa is substantially perpendicular to the winding surface 71A of the bobbin B" means that the wire W is wound in so that the pair of corners Wa, Wa is arranged along a substantial radial direction of the winding surface 71A of the cylinder. In cases where the bobbin B is a rectangular bobbin, "Being wound in such a way that the diagonal pair of corners Wa, Wa is substantially perpendicular to the winding surface 71A of the bobbin B" means that the wire W is wound so that the pair of corners Wa, Wa is arranged substantially perpendicularly to the flat portion of the winding surface 71A of the polygonal column.

Due to such a construction, the outer portion of the wire W includes the concave portion having the top portions 77 and the bottom portions 78 each having an obtuse angle, which increases the surface area resulting in improved cooling effect.

The corner Wa of the wound portion Wc of the second layer L2, which is wound on the outer side of the wound portion Wc of the first layer L1, fits into the concave portion Wd formed by the corners Wa, Wa of the wound portions Wc, Wc of the first layer L1, which are adjacently wound along the rotation axis of the bobbin B.

Due to such a construction, the top portions 77 and the bottom portions 78 of the concave portion formed on the outer portion of the first layer L1 fit into the top portions 77 and the bottom portions 78 of the concave portion formed on the inner portion of the second layer L2 and thus the wire W is wound reliably with higher density.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A winding apparatus for winding a wire on a bobbin comprising:

a forming device which receives the wire when the wire possesses a rounded cross-section and forms the wire having the rounded cross-section into wire having a cross-section different from the rounded cross-section, the forming device comprising a forming roller operatively connected to a first motor so that operation of the first motor rotates the forming roll;

a winding device configured to wind the wire formed by the forming device on a winding surface of the bobbin;

a second motor operatively connected to the winding device so that operation of the second motor drives the winding device to wind the wire on the surface of the bobbin; and the first and second motors being servo-controlled so that the wire is fed out of the forming roller synchronously with the driving of the winding device.

2. The wire winding apparatus according to claim 1, wherein the winding device rotates at a constant speed while the forming device drives, without setting a torque limit, to give as low a tension as possible to the wire between the forming device and the winding device.

3. The wire winding apparatus according to claim 1, wherein the winding device rotates at a constant speed while the forming device drives, without setting torque limit, to give as low a tension as possible to the wire between the forming device and the winding device based on pulses of an encoder of the winding device.

4. The wire winding apparatus according to claim 1, wherein the forming device includes plural forming rollers which receive the wire when the wire possesses the rounded cross-section and forms the wire having the rounded cross section into the wire having a cross-section different from the rounded cross-section, and the rotation of the forming rollers being controlled to follow a wire speed of the wire wounded by the winding device.

5. The winding apparatus according to claim 1, wherein the forming device receives the wire when the wire possesses the rounded cross-section and forms the wire having the rounded cross-section into wire having a polygonal cross-section.

6. The wire winding apparatus according to claim 1, further comprising a wire feeding device feeding the wire with the rounded cross section to the forming device, wherein the wire feeding device drives synchronously with feeding of the wire by the forming device.

7. The wire winding apparatus according to claim 1, further comprising a tension adjusting device which adjusts tension of the wire between the forming device and the winding device and absorbs synchronization error between the forming device and the winding device.

8. A method for winding a wire on a bobbin comprising:

directing a wire possessing a rounded cross-sectional shape to a rotating forming roll which is rotatably driven by a first motor to change the cross-sectional shape of the wire from the rounded cross-sectional shape to a formed cross-sectional shape different from the rounded cross-sectional shape;

winding the wire possessing the formed cross-sectional shape on a bobbin through operation of a winding device which is operatively connected to and driven by a second motor; and servo-controlling the first and second motors to feed the wire out of the forming roller synchronously with the driving of the winding device.

9. The method according to claim 8, further comprising rotating the winding device at a constant speed and driving the forming device without setting a torque limit so as low a tension as possible is imparted to the wire between the forming device and the winding device.

10. The method according to claim 8, further comprising rotating the winding device at a constant speed and driving the forming device without setting a torque limit so as low a tension as possible is imparted to the wire between the forming device and the winding device based on pulses of an encoder of the winding device.

11. The method according to claim 8, wherein the forming device which changes the cross-sectional shape of the wire includes a plurality of forming rollers, and one of the forming rollers being rotated to follow a wire speed of the wire wound by the winding device.

12. The method according to claim 8, wherein the cross-sectional shape of the wire is changed from the rounded cross-sectional shape to a polygonal cross-sectional shape.

13. The method according to claim 8, further comprising adjusting tension of the wire between the forming device and the winding device to absorb synchronization error between the forming device and the winding device.

* * * * *